US007407011B2

(12) United States Patent
Kent

(10) Patent No.: US 7,407,011 B2
(45) Date of Patent: Aug. 5, 2008

(54) TUBING ANNULUS PLUG VALVE

(75) Inventor: Peter M. Kent, Inverurie (GB)

(73) Assignee: Vetco Gray Inc., Houston, TX (US)

( * ) Notice: Subject to any disclaimer, the term of this patent is extended or adjusted under 35 U.S.C. 154(b) by 239 days.

(21) Appl. No.: 11/231,577

(22) Filed: Sep. 21, 2005

(65) Prior Publication Data

US 2006/0076130 A1 Apr. 13, 2006

Related U.S. Application Data

(60) Provisional application No. 60/613,609, filed on Sep. 27, 2004.

(51) Int. Cl.
*E21B 33/04* (2006.01)

(52) U.S. Cl. ..... 166/368; 166/75.14; 166/86.1; 166/88.1; 166/324

(58) Field of Classification Search ..... None
See application file for complete search history.

(56) References Cited

U.S. PATENT DOCUMENTS 5,769,162 A 6/1998 Bartlett et al.
6,763,891 B2 * 7/2004 Humphrey et al. ..... 166/368
6,840,323 B2 1/2005 Fenton et al.

FOREIGN PATENT DOCUMENTS

| | | | |
|---|---|---|---|
| GB | 2243383 | A | 10/1991 |
| GB | 2275952 | A | 9/1994 |
| GB | 2291085 | A | 1/1996 |
| GB | 2311544 | A | 10/1997 |

* cited by examiner

*Primary Examiner*—Zakiya W. Bates
(74) *Attorney, Agent, or Firm*—Bracewell & Giuliani LLP

(57) ABSTRACT

A tubing hanger lands in a tubular outer wellhead member and supports a string of production tubing. The tubing hanger has a production passage for communicating with the interior of the production tubing and an annulus passage for communicating with a tubing annulus on the exterior of the production tubing. An access port leads from the annulus passage to an exterior portion of the body for communicating the tubing annulus with the annulus passage. A valve stem is movable along an axis of the annulus passage between a closed position, blocking the access port, and an open position, exposing the annulus port. A pressure equalizing passage extends from the annulus passage above the valve stem to the annulus passage below the valve stem.

20 Claims, 4 Drawing Sheets

TUBING ANNULUS PLUG VALVE

CROSS REFERENCE TO RELATED APPLICATION

This application claims priority to provisional application Ser. No. 60/613,609, filed Sep. 27, 2004.

FIELD OF THE INVENTION

This invention relates in general to subsea wellhead tubing hangers, and in particular to a tubing hanger having a tubing annulus passage with a hydraulically actuated plug valve located therein.

BACKGROUND OF THE INVENTION

An oil or gas well typically has a string of tubing through which the well fluid flows. The tubing is suspended in casing and supported by a tubing hanger at its upper end. The tubing hanger lands in a wellhead member, which may be a wellhead housing, a tubing spool mounted on top of a wellhead housing, or a production tree. For various workover and completion operations, the operator needs to be able to pump fluids down the tubing and back up the tubing annulus surrounding the tubing, or vice-versa.

A tubing hanger has a production passage extending through it for communicating with the interior of the production tubing. One type of tubing hanger has a tubing annulus passage extending through the body of the tubing hanger alongside and parallel to the production tubing. In an offshore well completion, the operator may install a plug in the tubing annulus passage before the production tree is installed. After the tree is installed, the operator retrieves the plug with a wireline retrieval tool.

Alternately, a tubing annulus valve could be installed in the tubing hanger before running the tubing hanger. A valve eliminates the need for a riser having passage through which a wire line tubing annulus plug could be run. The valve may be a spring-biased check valve or a hydraulically actuated valve. A number of designs for tubing annulus valves are shown in the patented art. For various reasons, particularly concerns about the reliability, tubing annulus valves are not in widespread use.

SUMMARY

The tubing hanger of this invention has a production passage for communicating with the interior of the production tubing, and an annulus passage for communicating with the tubing annulus on the exterior of the production tubing. An access port leads from the annulus passage to an exterior portion of the body for communicating the tubing annulus with the annulus passage. A valve stem is carried sealingly in the annulus passage for movement along an axis of the annulus passage between a closed position, blocking the access port, and an open position, exposing the annulus port. The valve stem is a solid plug member and does not have any passages extending through it.

A pressure equalizing passage extends from an upper portion of the tubing annulus passage, above the valve stem, to a lower portion, below the valve stem. The pressure equalizing passage equalizes pressure in the annulus passage at the upper and lower ends of the valve stem while the valve stem is in the open position.

In the preferred embodiment, the valve stem is hydraulically actuated for movement between the open and closed positions. The valve stem has an annulus piston band located between the upper and lower ends that are acted on by the hydraulic pressure.

In one embodiment, the valve stem is located in an extended portion of the tubing hanger body. The extended portion extends downward alongside and parallel to the tubing. In another embodiment, the valve stem is located in the main body of the tubing hanger.

DETAILED DESCRIPTION OF THE INVENTION

Figure 1A:
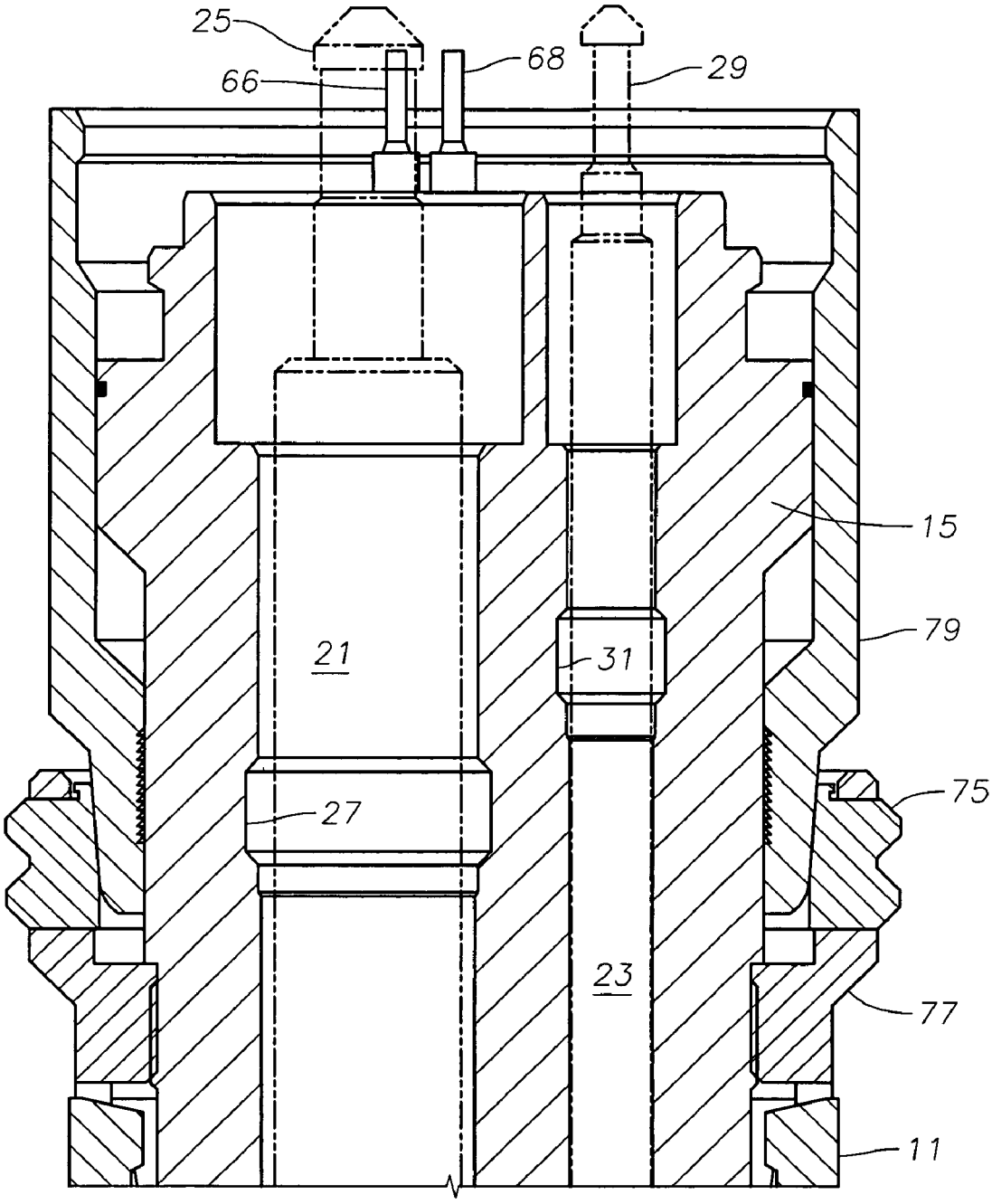
FIGS. 1A and 1B comprise a vertical sectional view of a tubing hanger having a tubing annulus valve assembly constructed in accordance with this invention.
Figure 1B:
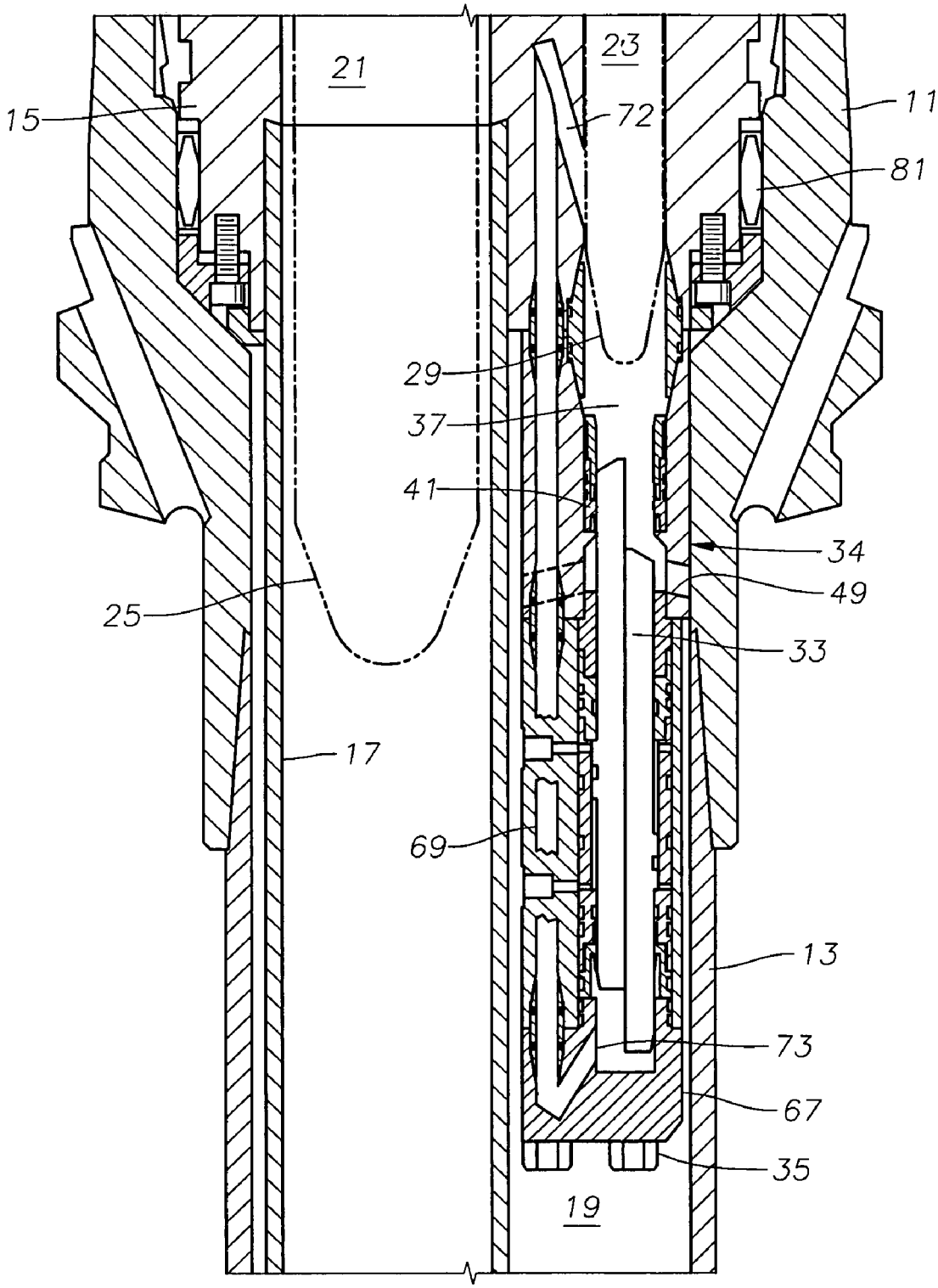

Referring to FIG. 1B, a casing hanger 11 of conventional design is supported within a subsea wellhead housing (not shown). A string of casing 13 secures to the lower end of casing hanger 11 and extends into the well. Casing 13 will be cemented in place. The well may have additional casing hangers and strings of casing.

A tubing hanger 15 lands on casing hanger 11 in this embodiment. Alternately, tubing hanger 15 could land above casing hanger 11 within a tubing hanger spool located above the wellhead housing that supports casing hanger 11. A string of production tubing 17 extends downward from tubing hanger 15 into the well. The well produces through tubing 17, or if the well is an injection well, fluid flows downward through tubing 17. A tubing annulus 19 surrounds tubing 17 within casing 13.

Tubing hanger 15 has a production bore 21 that is aligned with and communicates with the passage in production tubing 17. Tubing hanger 15 also has a tubing annulus bore 23, which is offset and parallel to production bore 21. Normally tubing annulus bore 23 is smaller in diameter than production bore 21. Tubing annulus bore 23 communicates with tubing annulus 19 to enable an operator to circulate fluid between tubing annulus 19 and production bore 21.

Referring to FIG. 1A, a production isolation plug 25 is shown in phantom lines installed sealingly within production bore 21. Production isolation plug 25 has a locking member (not shown) that engages a profile 27 formed in production bore 21. Similarly, a tubing annulus isolation plug 29 is shown phantom lines installed sealingly within tubing annulus bore 19. Tubing annulus isolation plug 29 has a locking element that engages a profile 31 formed in tubing annulus bore 23. In the prior art technique, after tubing hanger 15 has been set and the well tested, the operator will install isolation plugs 25 and 29 by wire line. The operator then removes the completion riser string (not shown) and installs a Christmas tree. The tree has dual bores with stabs on its lower end that align with and stab into production and annulus bores 21 and 23. Once the tree is installed, the operator retrieves isolation plugs 25 and 29 with a wireline tool.

In this invention, a hydraulically actuated tubing annulus valve, shown in FIG. 1B, selectively opens and closes tubing annulus bore 23. The tubing annulus valve eliminates the need for running and retrieving annulus plug 29, unless the operator wants to provide profile 31 for annulus plug 29 in the event the tubing annulus valve fails to close or leaks. In this invention, the hydraulically actuated valve assembly has a movable plug or valve stem 33. Valve stem 33 is shown in the upper closed position on the left side and in the lower open position on the right side. Valve stem 33 is a solid plug member that moves axially within an extension member 34 in this embodiment.

Figure 2A:
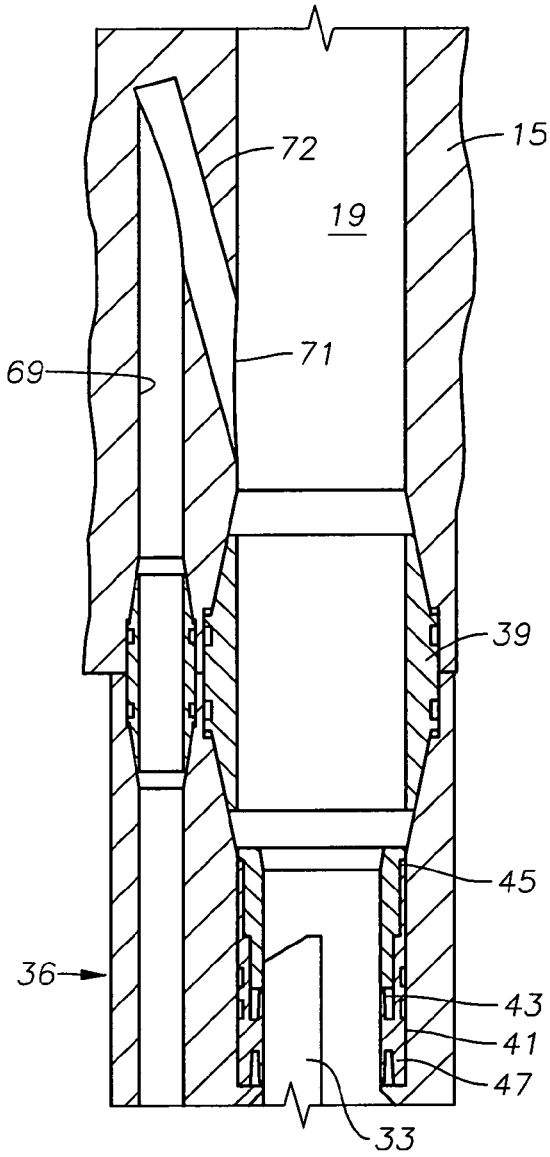
FIGS. 2A and 2B comprise an enlarged vertical sectional view of the tubing annulus valve assembly of FIG. 1.
Figure 2B:
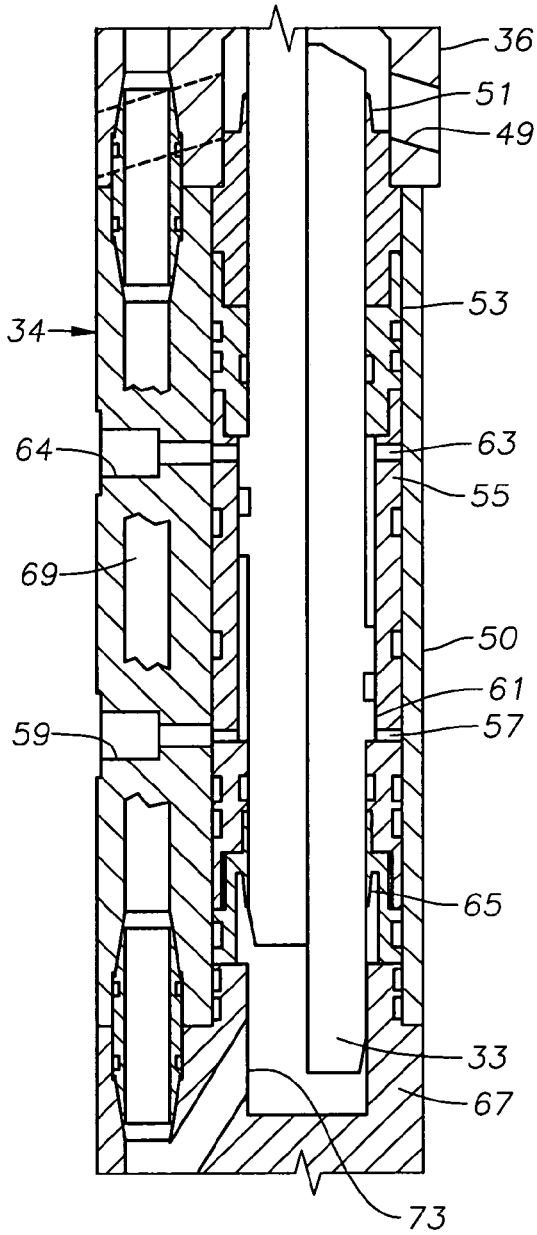

Extension member 34 is a tubular member that is secured to the lower end of tubing hanger 15, such as by fasteners 35 (FIG. 1B), and forms a part of the body of tubing hanger 15. Referring to FIGS. 2A and 2B, in this embodiment, extension member is a multi-piece member, although it could be constructed otherwise. Extension member 34 has an upper portion 36 that abuts the lower end of tubing hanger 15. Extension member 34 has a central bore 37 with a closed lower end and is coaxial with tubing annulus bore 23. A joint seal 39 seals between tubing annulus bore 23 and central bore 37. Central bore 37 may be considered to be a part of tubing annulus bore 23.

An upper seal 41 is stationarily mounted in extension member upper portion 36. Upper seal 41 is preferably a metallic seal having legs 43 that sealingly engages a portion of valve stem 33 when valve stem 33 is in the upper position. Upper seal 41 is held by a retainer 45 on its upper end and a shoulder 47 on its lower end.

Referring to FIG. 2B, at least one annulus access port 49 extends through the sidewall of extension member upper portion 36 to a junction with central bore 37. Annulus access ports 49 provide communication of tubing annulus 19 (FIG. 1B) with extension member central bore 37. Annulus access ports 49 are located below upper seal 41 and above an intermediate seal 51. Intermediate seal 51 is preferably a metallic seal with a leg that sealingly engages valve stem 33 regardless of the position of valve stem 33.

A retainer 53 secures to the body of intermediate seal 51, holding it in stationary abutment with the lower end of extension member upper portion 36. Retainer 53 and a lower portion of intermediate seal 51 are located within a central portion 50 of extension member 34. A porting sleeve 55 locates within central bore 37 below retainer 53. Porting sleeve 55 is preferably secured by threads to retainer 53, which in turn is secured by threads to the body of intermediate seal 51.

Porting sleeve 55 has an upstroke port 57 extending through its sidewall in communication with central bore 37. Upstroke port 57 leads to an upstroke hydraulic passage 59 for supplying hydraulic fluid pressure to central bore 37 on the lower side of an annular piston band 61. Piston band 61 is integrally formed on the outer diameter of valve stem 33 and sealingly engages the inner diameter of porting sleeve 55. Similarly, a downstroke port 63 locates above upstroke port 57. Downstroke port 63 communicates with a downstroke hydraulic passage 64. Passages 59, 64 extend through tubing hanger 15 and terminate in stab-type connectors 66, 68, respectively, at the upper end of tubing hanger 15. The running tool (not shown) for tubing hanger 15 has mating hydraulic connectors that stab into engagement with upstroke and downstroke hydraulic connectors 66, 68 for selectively supplying hydraulic fluid pressure to either the lower or the upper side of piston band 61 to cause valve stem 33 to move to the upper or lower position.

A lower seal 65, preferably metallic, secures to the lower end of porting sleeve 55. Lower seal 65 is retained on its lower end by a lower portion 67 of extension member 34. Lower seal 65 remains in engagement with part of valve stem 33 in both the upper and lower positions.

A pressure balance passage 69 extends through extension member 34 and part of tubing hanger 15 parallel to central bore 37. Referring to FIG. 2A, pressure balance passage 69 has a downward inclined portion 72 that leads from the upper end of the central portion of pressure balance passage 69 downward to tubing annulus bore 23. Downward inclined passage portion 72 reduces the movement of debris from extension member central bore 37 to the central portion of pressure balance passage 69. Similarly, a pressure balance passage 69 has a lower upward inclined portion 73 (FIG. 2B) formed in extension member lower portion 67. Upward inclined portion 73 reduces entry of debris from pressure balance passage 69 into extension member central bore 37.

The pressure area at the lower end of valve stem 33 at lower seal 65 is the same as the pressure area at intermediate seal 51 and upper seal 41. When valve stem 33 is in the open position, any pressure in tubing annulus 19 and tubing annulus bore 23 would act on the upper end of valve stem 33. Also, when valve stem 33 is closed, any pressure in tubing annulus bore would act on the upper end of valve stem 33. Equalizing passage 69 transmits the pressure in tubing annulus bore to the lower end of valve stem 33, removing any pressure differential across seals 51 and 65. This pressure balancing prevents fluid pressure in tubing annulus bore 23 from moving valve stem 33 downward from the closed position. Valve stem 33 moves only in response to hydraulic fluid pressure supplied to ports 59 or 64.

Referring again to FIG. 1A, tubing hanger 15 has a locking member 75 for engaging a profile within the wellhead housing (not shown). Locking member 75 may be of various types, and in this example, comprises a split ring carried by a holder 77 that forms a part of tubing hanger 15. An energizing sleeve 79, when pushed downward by the running tool (not shown), forces lock ring 75 radially outward into engagement with a profile in the wellhead housing. Referring to FIG. 1B, tubing hanger 15 has a seal 81 that sealingly engages a bowl within casing hanger 11. Other types of seals are also known in the art and feasible.

In operation, a running tool (not shown) secures to tubing hanger 15 to lower it into engagement with casing hanger 11. In one technique, the running tool is lowered on a dual string completion riser and is supplied with hydraulic fluid pressure from a separate line extending to the platform at the surface. The running tool has stabs that sealingly engage production bore 21 and tubing annulus bore 23. Plugs 25 and 29 will not be in place at this time. Preferably valve stem 33 is in the lower open position to enable the conduit connected to tubing annulus bore 23 to fill with well fluid during the running procedure.

After landing on casing hanger 11, the operator actuates the running tool in a conventional manner to set lock ring 75. An operator may wish to circulate between annulus bore 23 and production bore 21 to replace the fluid contained in casing 13. The operator can pump down one of the completion strings into tubing annulus bore 23, causing the fluid to flow out tubing annulus access ports 49 into tubing annulus 19. Typically, a sliding sleeve or other valve member at the lower end of tubing 17 causes the fluid being pumped down tubing annulus 19 to flow back up tubing 17, production bore 21 and the other completion string to the surface. The operator may perforate tubing 17 and casing 13 to complete the well either before or after this circulation step.

After the well has been tested, the operator would run production isolation plug 25 (FIG. 1A) through the running string into production bore 21. The operator need not install annulus isolation plug 29, rather simply closes valve stem 33 (FIG. 1B) by supplying hydraulic fluid pressure through the running tool to upstroke port 59. If a failure occurs, causing valve stem 33 to leak or fail to close, the operator could run annulus isolation plug 29 in a conventional manner through the completion string and set it within annulus bore 23. In this example, the lower end of isolation plug 29 terminates at the lower end of tubing hanger 15, as shown in FIG. 1B.

After completion, the operator will retrieve the running tool and completion riser and install a Christmas tree (not shown) with the completion riser in a conventional manner. The tree has hydraulic connectors that stab into hydraulic connections 66 and 68 to hand over the operation of valve stem 33 to the controls of the Christmas tree assembly. This control will allow the operator to selectively open and close tubing annulus passage 23 at later times with the tree in place. If valve stem 33 locks in an closed upper position, and cannot be moved downward by hydraulic pressure through port 64 (FIG. 2B), the operator can run a wireline tool downward through the annulus string of the completion riser into extension member central bore 37 to deliver a blow to the upper end of valve stem 33 to move it to the lower position. Since valve stem 33 is preferably a solid bar, the upper end of valve stem 33 may be considered to be an anvil.

After installation of the tree, the operator lowers a wireline tool through the production string of the completion riser and retrieves isolation plug 25. If an emergency isolation plug 29 has been installed in tubing annulus bore 23, the operator may use a wireline tool to retrieve it through the other string of the completion riser. The operator removes the completion riser after the tree has been installed and tested.

Other techniques may be used to run the tubing hanger. For example, the operator could run the tubing hanger running tool on a monobore string through the drilling riser. The operator circulates down the annulus by closing the blowout preventer on the running string and pumping down the choke and kill line of the drilling riser.

Figure 3:
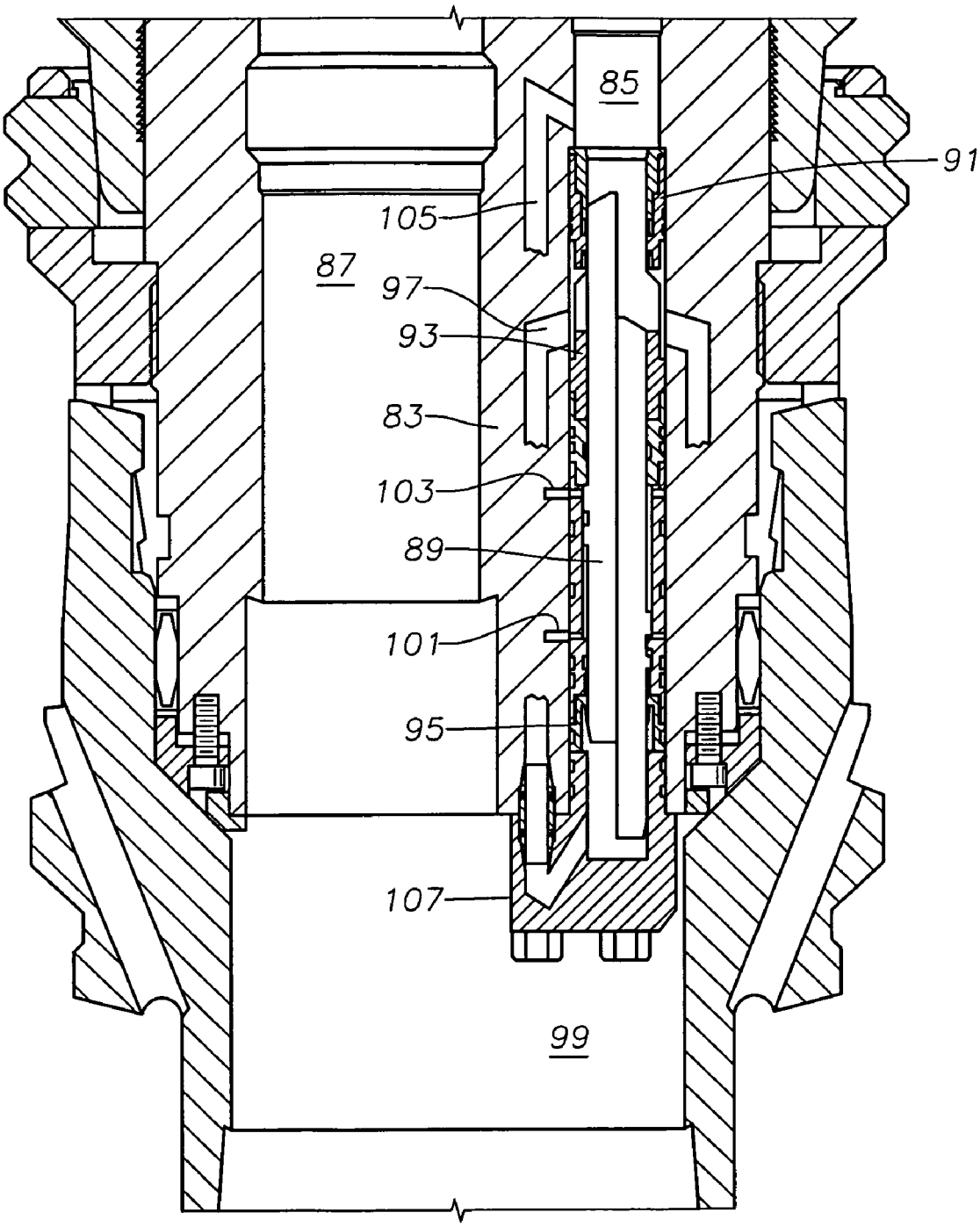
FIG. 3 is a sectional view of a portion of a tubing hanger having an alternate embodiment of a tubing annulus valve assembly constructed in accordance with this invention.

In the alternate embodiment of FIG. 3, tubing hanger 83 has a tubing annulus bore 85 and a production bore 87. In this embodiment, valve stem 89 is carried within the main portion of tubing annulus bore 85 in the main body of tubing hanger 83, rather than in an extended portion of the body below the main body of the tubing hanger as in the first embodiment. Valve stem 89 strokes between upper and lower positions. An upper seal 91 is mounted in tubing annulus bore 85. An intermediate seal 93 is secured below upper seal 91, and a lower seal 95 is secured adjacent the lower end of tubing annulus bore 85. Annulus access ports 97 extend from tubing annulus bore 85 between upper and intermediate seals 91, 93. Annulus access ports 97 lead to the lower end of tubing hanger 83 for communicating with tubing annulus 99.

Hydraulic ports 101 and 103 supply hydraulic fluid pressure to stroke valve stem 89 between the upper closed and lower open positions. Pressure balance passage 105 is formed within tubing hanger 83 parallel to tubing annulus bore 85. The upper end of pressure balance passage 105 joins tubing annulus bore 85 above upper seal 91. The lower end of pressure balance passage 105 is located within a short extension member 107 in this example. Extension member 107 is secured to the lower end of tubing hanger 83 and contains a closed end portion of tubing annulus bore 85. The upper and lower end portions of pressure balance passage 105 inclined downward and upward, respectively, as in the first embodiment.

The embodiment of FIG. 3 operates in the same manner as the first embodiment. The only difference would be if installing an annulus isolation plug, such as plug 29, the plug would necessarily need to have a shorter length.

The invention has significant advantages. The solid plug type of movable valve member is simple, strong and reliable. If debris or corrosion causes it to stick in a closed position, blows from a wire line hammer tool can be delivered to its upper end to free it. Pressure balancing avoids pressure in the tubing hanger annulus passage from tending to move the valve stem.

While the invention has been shown in only two of its forms, it should be apparent to those skilled in the art that it is not so limited but is susceptible to various changes without departing from the scope of the invention.

The invention claimed is:

1. A wellhead apparatus, comprising:

a tubing hanger body for landing in a tubular outer wellhead member and supporting a string of production tubing, the body having a production passage for communicating with the interior of the production tubing and an annulus passage for communicating with a tubing annulus on the exterior of the production tubing;

an access port leading from the annulus passage to an exterior portion of the body for communicating the tubing annulus with the annulus passage; and a valve stem carried sealingly in the annulus passage for movement along an axis of the annulus passage between a closed position, blocking the access port, and an open position, exposing the annulus port, the valve stem being a solid member dimensioned to prevent any flow through the valve stem from the annulus passage below the valve stem to the annulus passage above the valve stem.

2. The wellhead apparatus according to claim 1, further comprising:

a pressure equalizing passage extending from the annulus passage above the valve stem to the annulus passage below the valve stem to equalize pressure across the valve stem.

3. The wellhead apparatus according to claim 1, further comprising:

an annular hydraulic chamber in the annulus passage; and an annulus piston formed on the valve stem and sealingly located in the hydraulic chamber for moving the valve stem to the open position.

4. The wellhead apparatus according to claim 1, wherein the tubing hanger body comprises:

a main body portion and an extended body portion, the production passage having a lower end in the main body portion containing a set of threads for securing to the tubing, the extended body portion being secured to the main body portion and extending lower than the lower end of the production passage; and wherein the annulus passage extends into the extended body portion, and the valve stem is carried in the extended body portion.

5. The wellhead apparatus according to claim 1, further comprising:

at least one sleeve stationarily mounted in the annulus passage, the sleeve having a bore with an annular enlarged bore portion;

the valve stem extending into and being movable relative to the sleeve, the valve stem having an annular piston band thereon that is located in the enlarged bore portion;

an upper hydraulic passage through the sleeve to the enlarged bore portion above the piston band to move the valve stem upward; and a lower hydraulic passage through the sleeve to the enlarged bore portion below the piston band to move the valve stem downward.

6. The wellhead apparatus according to claim 1, wherein the access port joins the annulus passage at a point that is above the valve stem while the valve stem is in the closed position.

7. The wellhead apparatus according to claim 1, further comprising:

a first seal member mounted stationarily in the annulus passage at a point that is above the valve stem while the valve stem is in the open position and sealingly engaged by the valve stem while the valve stem is in the closed position;

a second seal member mounted stationarily in the annulus passage below the first seal member, the second seal member being engaged by the valve stem while the valve stem is in the open and closed positions; and wherein the access port joins the annulus passage between the first and second seal members.

8. A wellhead apparatus, comprising:

a tubing hanger body for landing in a tubular outer wellhead member and supporting a string of production tubing, the body having a production passage for communicating with the interior of the production tubing and an annulus passage for communicating with a tubing annulus on the exterior of the production tubing;

an access port leading from the annulus passage to an exterior portion of the body for communicating the tubing annulus with the annulus passage;

a valve stem carried sealingly in the annulus passage for movement along an axis of the annulus passage between a closed position, blocking the access port, and an open position, exposing the annulus port; and a pressure equalizing passage joining upper and lower portions of the annulus passage for equalizing any pressure in the annulus passage above the valve stem with pressure in the annulus passage below the valve stem.

9. The wellhead apparatus according to claim 8, wherein:

the valve stem has an upper end that comprises an anvil for receiving a blow from a wire line tool in the event the valve stem sticks.

10. The wellhead apparatus according to claim 8, wherein the tubing hanger body comprises:

a main body portion and an extended body portion, the extended body portion being offset from and parallel to the production passage and extending below a lower end of the production passage, the annulus passage extending through the main body portion and into the extended body portion; and wherein the valve stem is carried in the extended body portion in both the open and closed positions.

11. The wellhead apparatus according to claim 8, further comprising:

at least one sleeve stationarily mounted in the annulus passage, the sleeve having a bore with an annular enlarged bore portion; wherein the valve stem extends into and is movable relative to the sleeve, the valve stem having an annular piston band thereon that is located in the enlarged bore portion; and wherein at least one hydraulic passage extends through the sleeve to the enlarged bore portion for moving the piston from the open to the closed position.

12. The wellhead apparatus according to claim 8, wherein the access port joins the annulus passage at a point that is above an upper end of the valve stem while the valve stem is in the open position.

13. The wellhead apparatus according to claim 8, further comprising:

a first seal member mounted stationarily in the annulus passage at a point that is above a sealing portion on the valve stem while the valve stem is in the open position, the first seal member being sealingly engaged by sealing portion of the valve stem while the valve stem is in the closed position;

a second seal member mounted stationarily in the annulus passage below the first seal member, the second seal member being sealingly engaged by the sealing portion of the valve stem while the valve stem is in the open and closed positions;

wherein the access port joins the annulus passage between the first and second seal members; and the equalizing passage has a junction with the annulus passage above the first seal member and a junction with the annulus passage below the second seal member.

14. The wellhead apparatus according to claim 8, wherein the pressure equalizing passage comprises:

an upper segment extending generally upward from an upper equalizing junction with the annulus passage; and a central segment that joins and extends downward from the upper segment.

15. The wellhead apparatus according to claim 8, wherein the pressure equalizing passage comprises:

a lower segment extending generally downward from a lower equalizing junction with the annulus passage; and a central segment that joins and extends upward from the lower segment.

16. The wellhead apparatus according to claim 8, wherein the pressure equalizing passage comprises:

an upper segment extending generally upward from an upper equalizing junction with the annulus passage;

a lower segment extending generally downward from a lower equalizing junction with the annulus passage; and a central segment that joins an upper end of the upper segment with a lower end of the lower segment.

17. A wellhead apparatus, comprising:

a tubing hanger body for landing in a tubular outer wellhead member and supporting a string of production tubing, the body having a production passage for communicating with the interior of the production tubing and an annulus passage for communicating with a tubing annulus on the exterior of the production tubing;

an access port leading from an access port junction with the annulus passage to an exterior portion of the body for communicating the tubing annulus with the annulus passage;

an upper seal member stationarily mounted in the annulus passage above the access port junction;

an intermediate seal member stationarily mounted in the annulus passage below the access port junction;

a valve stem carried in the annulus passage for movement along an axis of the annulus passage between an upper closed position, in sealing engagement with the upper and intermediate seal members for closing the access port, and a lower open position in sealing engagement with the intermediate seal member but not the upper seal member, thereby opening the access port;

a lower seal member below the intermediate seal member, defining a hydraulic chamber in the annulus passage below the intermediate seal member and above the lower seal member;

a piston band on the valve stem and located in the hydraulic chamber;

a downstroke hydraulic passage leading to the hydraulic chamber above the piston band for stroking the valve stem to the lower open position; and a pressure equalizing passage extending alongside the annulus passage from an upper equalizing junction with the annulus passage above the upper seal member to a lower equalizing junction with the annulus passage below the lower seal member.

18. The wellhead apparatus according to claim 17, wherein the pressure equalizing passage comprises:

an upper segment extending generally upward from the upper equalizing junction; and a central segment that joins and extends downward from the upper segment.

19. The wellhead apparatus according to claim 17, wherein the pressure equalizing passage comprises:

a lower segment extending generally downward from the lower equalizing junction; and a central segment that joins and extends upward from the lower segment.

20. The wellhead apparatus according to claim 17, wherein the pressure equalizing passage comprises:

an upper segment extending generally upward from the upper equalizing junction;

a lower segment extending generally downward from the lower equalizing junction; and a central segment that joins an upper end of the upper segment with a lower end of the lower segment.

* * * * *

UNITED STATES PATENT AND TRADEMARK OFFICE

CERTIFICATE OF CORRECTION

PATENT NO. : 7,407,011 B2
APPLICATION NO. : 11/231577
DATED : August 5, 2008
INVENTOR(S) : Kent It is certified that error appears in the above-identified patent and that said Letters Patent is hereby corrected as shown below:

In the drawings

In Fig. 1B, Sheet 2 of 4, above Tag "72", delete " 23 " and insert -- 23 --, therefor.

In Column 5, Line 57, delete "inclined" and insert -- incline --, therefor.

Signed and Sealed this

Seventeenth Day of November, 2009

David J. Kappos

David J. Kappos
*Director of the United States Patent and Trademark Office*